US006146185A

United States Patent [19]

Cole et al.

[11] Patent Number: 6,146,185

[45] Date of Patent: Nov. 14, 2000

[54] CONTACT WIRE ASSEMBLY

[75] Inventors: Thelma E. Cole, Neshamic Station; Jason A. Kay, Morristown; David S. Kerr, Morris Plains, all of N.J.; Ivan Pawlenko, Holland, Pa.; Walter Pelosi, Randolph, N.J.; Anthony R. Tancreto, Brooklyn, N.Y.

[73] Assignee: Lucent Technologies, Inc., Holmdel, N.J.

[21] Appl. No.: 09/116,724

[22] Filed: Jul. 16, 1998

[51] Int. Cl.[7] ..... H01R 4/24

[52] U.S. Cl. ..... 439/399; 439/395; 439/404; 439/942

[58] Field of Search ..... 439/395, 399, 439/407, 404, 942, 397, 406

[56] References Cited

U.S. PATENT DOCUMENTS

| | | | |
|---|---|---|---|
| 4,231,632 | 11/1980 | Badoz et al. | 439/406 |
| 4,940,425 | 7/1990 | Hass et al. | 439/406 |
| 5,112,244 | 5/1992 | Kuzuno et al. | 439/395 |
| 5,554,046 | 9/1996 | Sugiyama et al. | 439/397 |
| 5,564,941 | 10/1996 | Norden | 439/410 |
| 5,577,930 | 11/1996 | Dahlem et al. | 439/399 |
| 5,591,044 | 1/1997 | Abe et al. | 439/397 |
| 5,624,273 | 4/1997 | Myer | 439/399 |
| 5,669,778 | 9/1997 | Kramer et al. | 439/398 |
| 5,695,358 | 12/1997 | Myer et al. | 439/468 |
| 5,830,004 | 11/1998 | Abe | 439/397 |
| 5,890,924 | 4/1999 | Endo et al. | 439/417 |
| 5,980,300 | 11/1999 | Okabe | 439/397 |

*Primary Examiner*—Paula Bradley
*Assistant Examiner*—Katrina Davis

[57] ABSTRACT

A contact wire connector includes a housing connected to an insulation displacement contact (IDC) and a contact sleeve. A strain relief member is connected to the housing opposite the IDC. The contact sleeve connects to a pin of a substrate and the IDC connects to an insulated wire which establishes an electrical connection between the substrate and the insulated wire. The strain relief member engages the insulated wire to maintain the electrical connection in an unstrained state.

6 Claims, 3 Drawing Sheets

CONTACT WIRE ASSEMBLY

FIELD OF THE INVENTION

The present invention relates to the field of electrical connectors, in particular to providing an electrical connection between insulated wire and a substrate.

BACKGROUND INFORMATION

Electrical connections between insulated wires and substrates have been established using soldering and wire-wrapping techniques. Soldering an insulated wire to a pin or terminal of a substrate requires stripping a portion of the insulation to expose the electrically-conductive wire portion. The user manually places the exposed wire portion in contact with the pin. A soldering iron generates heat which transforms solder into a liquid state. In its liquid state, the user places solder on the area of contact between the pin and wire portion. When the solder solidifies, a permanent electrical connection is established between the substrate and wire portion. Although soldering to establish a permanent electrical connection has generally been accepted, such a technique requires the user to possess skill and is time consuming. Further, the heat generated while soldering a wire portion to a pin of a substrate can cause damage to electrical and electronic components connected to the substrate and insulated wire.

Wire wrapping has also been used to establish a connection between an insulated wire and a pin of a substrate. Such a technique involves a user loading insulated wire into a wire-wrapping tool. Loading requires a user to feed the wire through a hole on a bit, and place the wire in a notch on a sleeve of the tool. After the tool is loaded, it is placed on a pin and activated. This causes the bit to rotate within the sleeve. As the bit rotates, the insulated wire is stripped as it is pulled through the hole, and cut at a predetermined length. The resultant exposed wire portion is wrapped around the pin. The wire-wrapping tool may be, for example, a pneumatic or an electrical gun-type. Although wire wrapping has generally been accepted to establish a permanent electrical connection, several short comings exist. For instance, wire wrapping is time consuming, at times the insulation is not properly removed from the wire, the length of the cut wire is not always accurate, it requires the user to possess skill, and it is ergonomically inefficient and thus can lead to injuries for the user, for example, such as carpal-tunnel syndrome.

SUMMARY OF THE INVENTION

An object of the present invention is to provide a reliable, electrical connection in a fast and easy manner.

Another object of the present invention is to provide a contact wire connector which can establish and maintain a permanent electrical connection in an unstrained state.

It is still another object of the present invention to provide a contact wire connector to minimize the connection time between a substrate and an insulated wire.

It is still yet another object of the present invention to provide a contact wire connector which can be stamped from the same material in a unitary piece.

It is still yet another object of the present invention to provide a contact wire assembly having contact wire connectors which can be arranged in close proximity with each other.

An aspect of the present invention provides a contact wire connector which includes a housing, an insulation displacement contact (IDC), a contact sleeve, and a strain relief member. Each of the contact sleeve, IDC, and strain relief member are connected to the housing. Further, the strain relief member is arranged opposite to the IDC. The contact sleeve connects to a pin of a substrate and the IDC connects to an insulated wire to establish an electrical connection between the substrate and the insulated wire. The strain relief member engages the insulated wire to maintain the electrical connection in an unstrained state.

Another aspect of the present invention provides a contact wire connector which includes a housing, an IDC, a contact sleeve, and a strain relief member. Each of the contact sleeve, IDC, and strain relief member are connected to the housing. Further, the housing, contact sleeve, IDC, and strain relief member are formed from electrically-conductive material as a unitary piece.

It is yet another aspect of the present invention to provide a contact wire assembly which includes a plurality of contact wire connectors. Each of the plurality of contact wire connectors includes a housing. Further, each of the contact sleeve, IDC, and strain relief member are connected to the respective housing and the IDC and strain relief member are arranged opposite to each other. In this aspect of the present invention, the IDC is adapted to connect to an insulated wire, the contact sleeve is adapted to connect to a pin of a substrate, and the strain relief member is adapted to place the electrical connection in an unstrained state. Further, each one of the plurality of contact wire connectors 100 are adapted to be disposed adjacent to another of the plurality of contact wire connectors 100.

DETAILED DESCRIPTION

Figure 1:
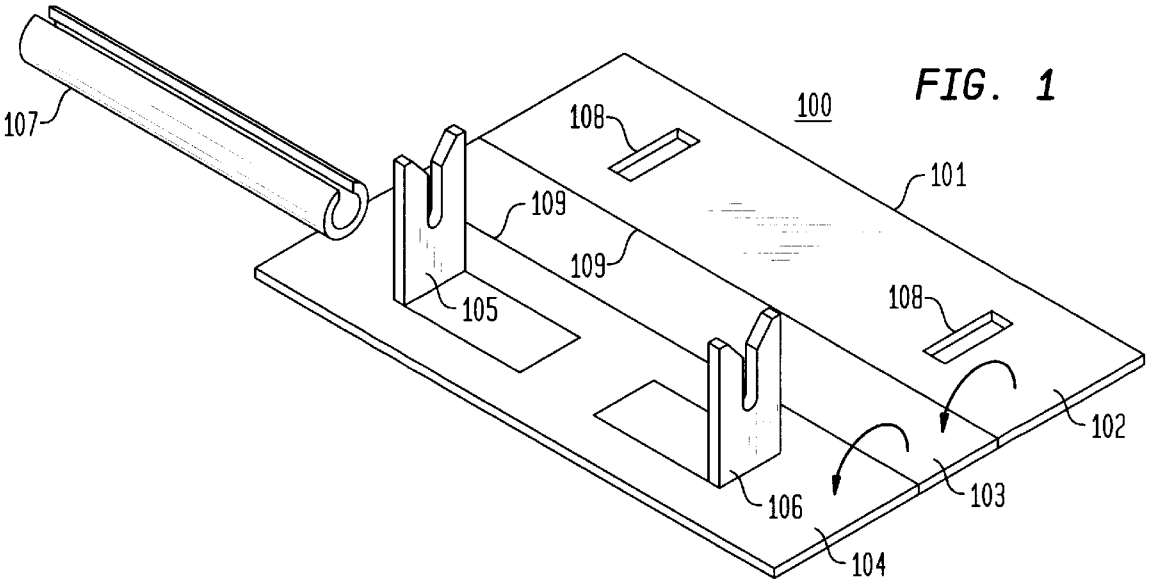
FIG. 1 shows an exemplary embodiment of an contact wire connector of the present invention in an open state.

The present invention includes a contact wire connector for providing an electrical connection between a substrate 201 and an insulated wire 203. The insulated wire 203 may be connected to, for example, electrical components and/or devices (not shown). As shown in FIG. 1, an exemplary embodiment of the present invention includes a contact wire connector 100 in its open position (pre-termination state) which has a housing 101, contact sleeve 107, insulation displacement contact (IDC) 105, and strain relief member 106. The contact sleeve 107, strain relief member 106 and IDC 105 are connected to the housing 101 and arranged such that the strain relief member 106 is opposite the IDC 105. In an exemplary embodiment of the present invention, the contact wire connector 100, is formed, for example, from a piece of stock material as a unitary piece. The IDC 105 provides a gas-tight electrical connection, as is known in the art, with an insulated wire 203.

Figure 2:
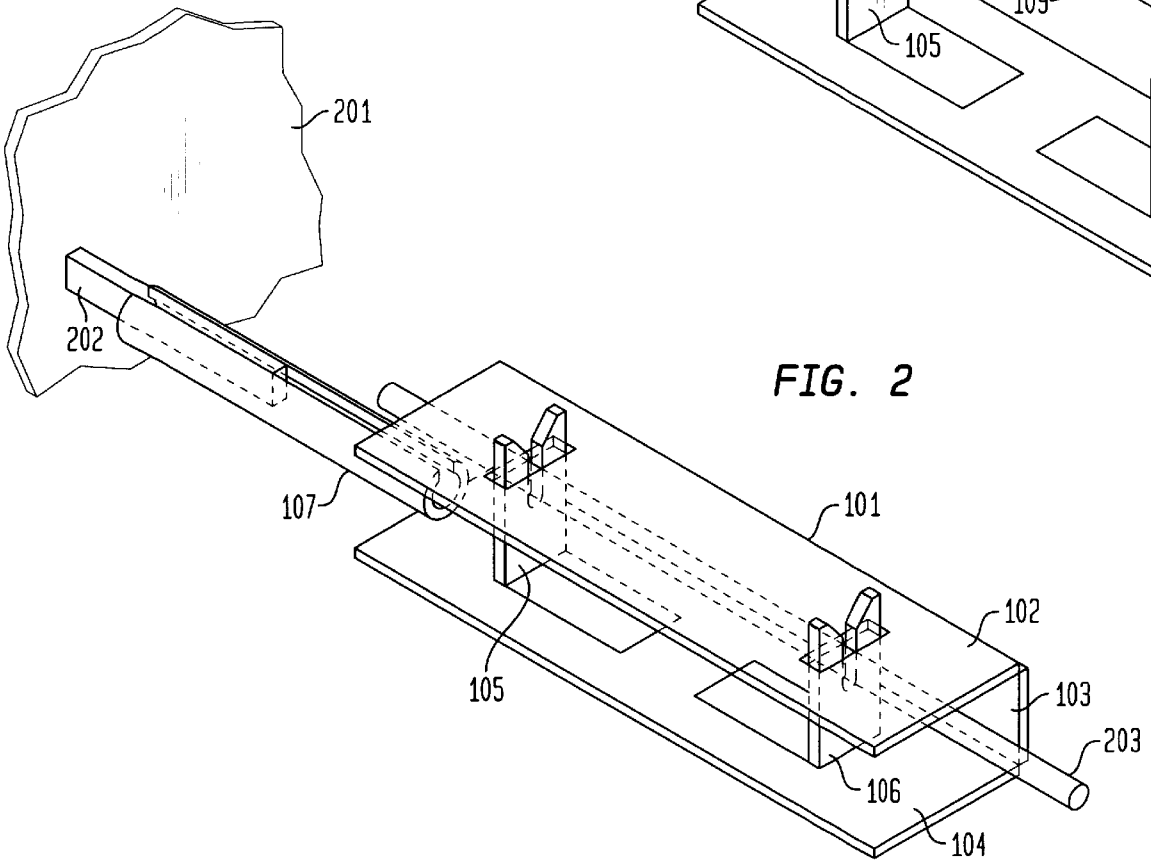
FIG. 2 shows an exemplary embodiment of the contact wire connector of FIG. 1 in a closed state.

FIG. 2 illustrates an exemplary embodiment of the contact wire connector 100 of FIG. 1 in its closed position (termination state). The contact sleeve 107 is adapted to connect to a pin or terminal 202 (hereinafter "pin") of a substrate 201, for example, such as printed circuit boards (PCB), printed wiring boards (PWB), and back planes. When a pin 202 is connected to the contact sleeve 107, an electrical connection is established between an insulated wire 203 connected to the contact wire connector 100 and the substrate 201. In an exemplary embodiment of the present invention, the contact sleeve 107 is constructed of, for example, an electrically-conductive and malleable material which allows the contact sleeve 107 to connect to pins 202 of a variety of shapes and sizes. The pins 202 can include, but are not limited to, a shape which is round, square, or rectangular, and various dimensions. As the pin 202 is inserted into the contact sleeve 107, a portion of the contact sleeve 107 may conform to the shape of the pin 202. Further, to reduce manufacturing cost, the contact sleeve 107 can be constructed from the same material as the housing 101, IDC 105 and strain relief member 106. The material can be, but is not limited to, an electrically-conductive and malleable material such as a conductive plastic or thin gauge metal, for example, cooper or brass.

In an exemplary embodiment of the present invention, as shown in FIG. 2, the housing 101 includes a first panel 104, a second panel 103 and a third panel 102. In this embodiment, the second panel 103 is positioned between the first panel 104 and the third panel 102. The panels may be divided between each other, for example, by pre-scored lines 109. Further, the third panel 102 includes two apertures 108 which correspond to the IDC 105 and the strain relief member 106, respectively. The housing 101 is constructed of, for example, an electrically-conductive and malleable material which allows the housing 101 to be switched between an open position, as shown in FIG. 1, and a closed position, as shown in FIG. 2. In an exemplary embodiment of the present invention, the panels can be manually moved with respect to each other along respective pre-scored lines 109.

Figure 3:
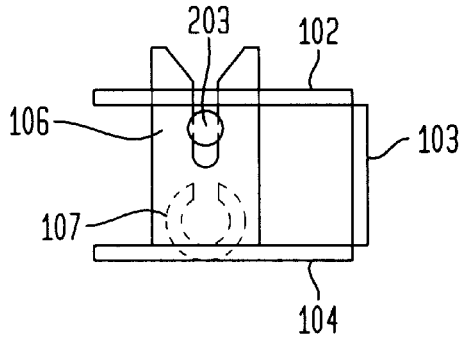
FIG. 3 shows a cross-sectional view of the contact wire connector of FIG. 2.

In the closed position, the third panel 102 is positioned so that the IDC 105 and the strain relief member 106 are respectively placed within the two apertures 108 of the third panel 102. Further, the IDC 105 connects to an insulated wire 203 and the strain relief member 106 maintains the electrical connection in an unstrained state. In an exemplary embodiment of the present invention, as shown in FIG. 3, a portion of the housing 101 stays in contact with the insulated wire 203 when the insulated wire 203 is electrically connected to the IDC 105 and engaged with the strain relief member 106. Thus, the housing, as shown in FIG. 3, maintains the electrical connection between the IDC 105 and insulated wire 203 and the engagement between the strain relief member 106 and insulated wire 203. For example, in an exemplary embodiment of the present invention, the third panel 102 of the housing 101, in its closed position, maintains contact with the insulated wire 203 to keep the wire engaged with the strain relief member 106 and IDC 105 as shown in FIG. 3.

The strain relief member 106 of the present invention is also adapted to maintain the electrical connection between the IDC 105 and insulated wire 203 in an unstrained state. The strain relief member 106 maintains the electrical connection in an unstrained state by engaging the insulated wire 203 at a location in front of the IDC 105. In an exemplary embodiment of the present invention, the electrical connection is an area of contact between the IDC 105 and an electrically-conductive portion of the insulated wire 203. Thus, the strain relief member 106 holds the insulated wire 203 in place and redirects pressure that may be exerted on the insulated wire 203. For example, the insulated wire 203 may be accidentally or purposefully pulled, or subjected to vibrations. The strain relief member 106 can redirect the pressure that would otherwise have been placed on the electrical connection to the housing 101. Thus, the strain relief member 106 of the present invention prevents the electrical connection between the IDC 105 and insulated wire 203 from being disconnected in response to tension applied to the insulated wire. In another exemplary embodiment, the strain relief member 106 may also electrically connect to the insulated wire 203 and form a second electrical connection.

Figure 4:
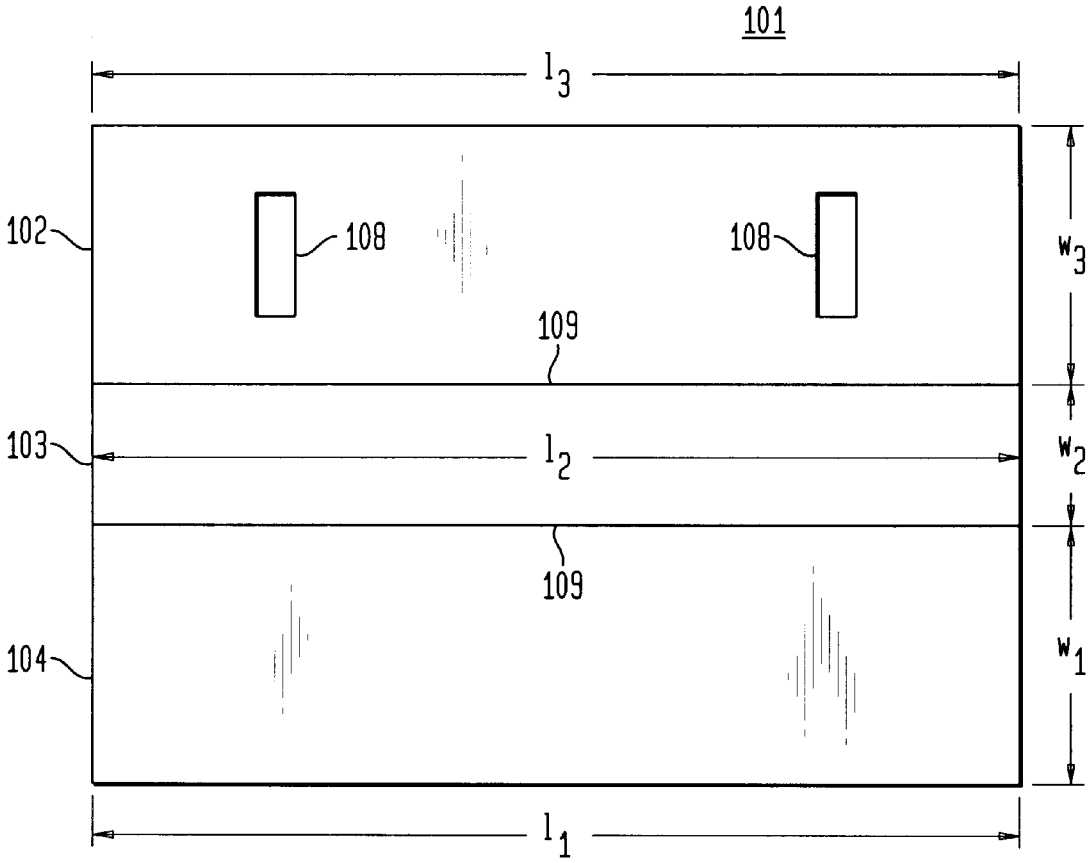
FIG. 4 shows an exemplary embodiment of a housing of the present invention.
Figure 5:
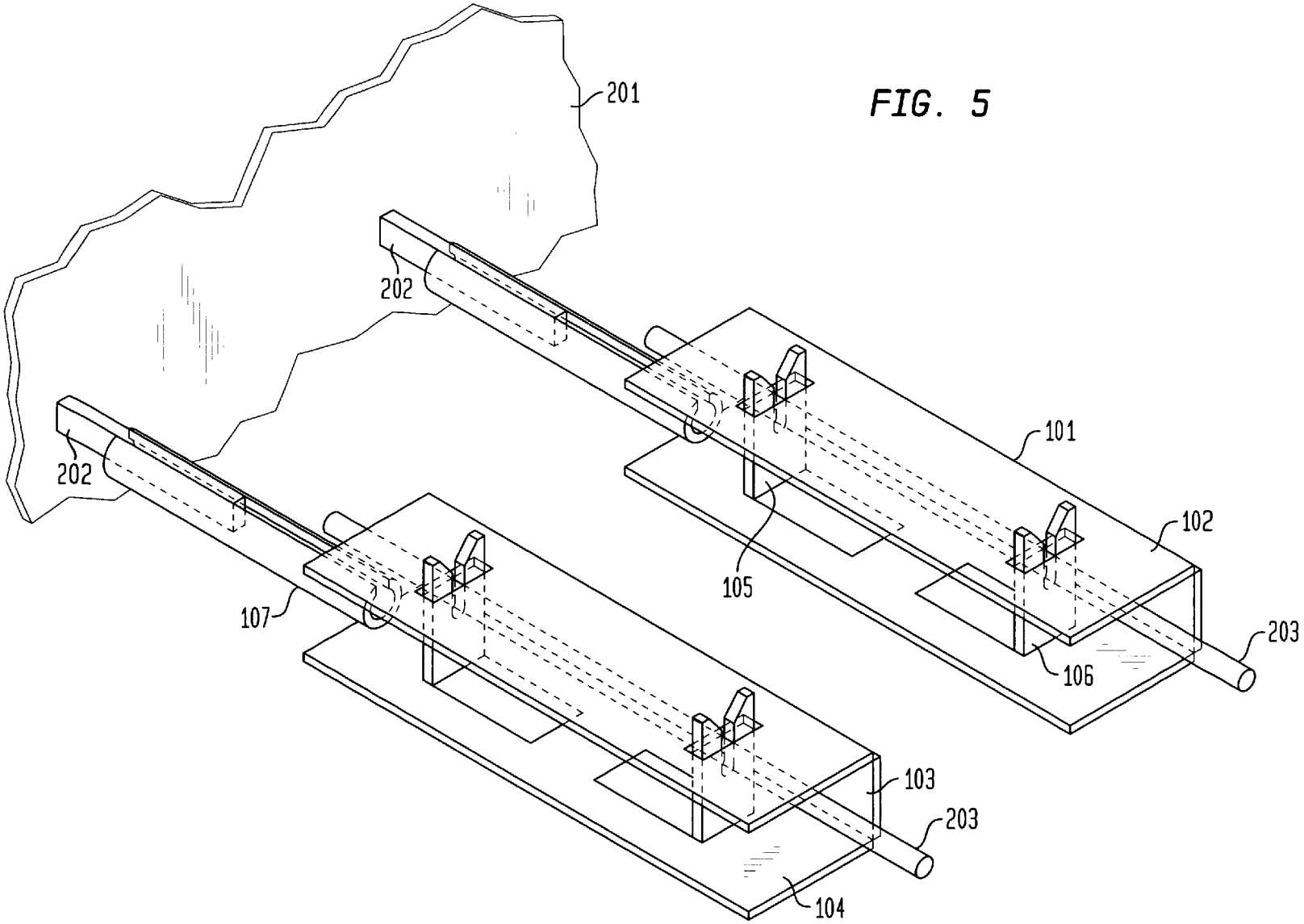
FIG. 5 shows an exemplary embodiment of a contact wire assembly of the present invention.

In certain applications, the distance between pins 202 on a substrate 201 is small. For example, the pins of a back plane in the telecommunication industry can be placed as close to each other as ⅛". Thus, each of the contact wire connectors 100 of the present invention can be adapted to be disposed adjacent to another of the plurality of contact wire connectors 100. In an exemplary embodiment of a housing 101 of the present invention, as shown in FIG. 4, a first width, $w_1$, and first length, $l_1$, of a first panel 104 is approximately ⅛", ½", respectively. In this embodiment of the present invention, a second width, $w_2$, and second length, $l_2$, of a second panel 103 of the housing 101 is approximately ⅛", ½", respectively. Further, in this embodiment of the present invention, a third width, $w_3$, and third length, $l_3$, of a third panel 102 of the housing 101 is approximately ⅛", ½", respectively. Accordingly, the contact wire connectors 100 of the present invention which include housings 101 which have panels 102, 103, 104 with such dimensions will allow a plurality of contact wire connectors 100 to be placed in close proximity to each other, as shown in FIG. 5. The contact wire connectors 100 are adapted to be disposed adjacent to another of the plurality of contact wire connectors 100. In an exemplary embodiment of the present invention, the electrical connectors 100 can be stacked with each other allowing numerous electrical connections in a confined area. The stacked-arrangement requires, for example, that the contact wire connectors 100 are electrically insulated from each other, for example, by an electrically-nonconductive material.

Further, the contact wire connectors 100 of the present invention will maintain the twists in respective insulated wires, such as category five wire. In applications which require a large number of contact wire connectors 100, the insulated wires 203 to be connected to the contact wire connectors 100 are color-coded. Thus, a user can install the contact wire connectors 100 by identifying which of the respective pins are to be connected to which of the respective color-coded wires in a quick and easy manner. Accordingly, the contact wire assembly of the present invention can be pre-assembled and mass-produced, reducing the time and cost for manufacturing. However, if necessary, the contact wire assembly can also be performed in the field, that is, at the location of the substrate 201 which is to be connected to the contact wire assembly.

The embodiments described above are illustrative examples of the present invention and it should not be construed that the present invention is limited to these particular embodiments. Various changes and modifications may be effected by one skilled in the art without departing from the spirit or scope of the invention as defined in the appended claims.

What is claimed is:

1. A contact wire connector comprising:

a housing;

an insulation displacement contact (IDC) integrally connected to the housing;

a contact sleeve integrally connected to the housing; and a strain relief member integrally connected to the housing opposite the IDC;

wherein the housing further comprises a first panel, a second panel, and a third panel having two apertures the second panel being positioned between the first panel and the third panel, wherein when the housing is placed in a closed position, the IDC and the strain relief member are respectively placed within the two apertures of the third panel; and wherein the contact sleeve connects to a pin of a substrate and the IDC connects to an insulated wire to establish an electrical connection between the substrate and the insulated wire, and the strain relief member engaging the insulated wire to maintain the electrical connection in an unstrained state.

2. The contact wire connector according to claim 1, wherein the electrical connection includes an area of contact between the IDC and an electrically-conductive portion of the insulated wire.

3. The contact wire connector according to claim 1, wherein:

a first width and a first length of the first panel are approximately ⅛", ½", respectively;

a second width and a second length of the second panel are approximately ⅛", ½", respectively; and a third width and a third length of the third panel are approximately ⅛", ½", respectively.

4. The contact wire connector according to claim 1, wherein the contact sleeve is constructed of a malleable, electrically-conductive material allowing the contact sleeve to connect to pins having a variable shape and size.

5. The contact wire connector according to claim 1, wherein the housing is constructed of a an electrically-conductive material allowing the housing to be switched between an open position and a closed position.

6. The contact wire connector according to claim 1, wherein the strain relief member forms a second electrical connection with the insulated wire.

* * * * *